US006845751B2

(12) United States Patent
Lee

(10) Patent No.: US 6,845,751 B2
(45) Date of Patent: Jan. 25, 2005

(54) METHOD AND APPARATUS FOR CONTROLLING IDLE SPEED OF AN ENGINE

(75) Inventor: Jae-Hyung Lee, Seoul (KR)

(73) Assignee: Hyundai Motor Company, Seoul (KR)

( * ) Notice: Subject to any disclaimer, the term of this patent is extended or adjusted under 35 U.S.C. 154(b) by 25 days.

(21) Appl. No.: 10/330,382

(22) Filed: Dec. 27, 2002

(65) Prior Publication Data

US 2003/0209225 A1 Nov. 13, 2003

(30) Foreign Application Priority Data

May 9, 2002 (KR) ..... 2002-25571

(51) Int. Cl.[7] ..... F02D 41/08
(52) U.S. Cl. ..... 123/339.23; 123/339.16
(58) Field of Search ..... 123/339.23, 339.16, 123/399, 339.2

(56) References Cited

U.S. PATENT DOCUMENTS 6,009,852 A * 1/2000 Akabori et al. ..... 123/339.19
6,019,085 A * 2/2000 Sato et al. ..... 123/339.22
6,082,329 A * 7/2000 Kazumasa ..... 123/339.18
6,116,213 A * 9/2000 Yasui et al. ..... 123/339.11
6,626,144 B1 * 9/2003 Kanamaru ..... 123/399

FOREIGN PATENT DOCUMENTS

JP 263688 * 10/1993 ..... F02D/41/08
JP 185388 * 7/1994 ..... F02D/41/08
JP 26048 * 1/1998 ..... F02D/41/08
JP 246142 * 9/1998 ..... F02D/41/08
JP 328819 * 11/2003 ..... F02D/41/08

* cited by examiner

*Primary Examiner*—Hai Huynh
(74) *Attorney, Agent, or Firm*—Morgan Lewis & Bockius LLP

(57) ABSTRACT

In the invention an apparatus and method direct an engine speed to converge to a target idle speed by detecting a current engine speed, calculating a dynamic reference speed based on the current engine speed, calculating a target idle speed actuator (ISA) opening based on the dynamic reference speed and the current engine speed, and actuating the ISA based on the target ISA opening.

28 Claims, 4 Drawing Sheets

METHOD AND APPARATUS FOR CONTROLLING IDLE SPEED OF AN ENGINE

FIELD OF THE INVENTION

The present invention relates to a method and apparatus for controlling the idle speed of an engine, and more particularly, to a method and apparatus for more stably controlling the idle speed.

BACKGROUND OF THE INVENTION

A gasoline engine generates power by burning a fuel/air mixture in a combustion chamber. Such a gasoline engine is equipped with a throttle valve for controlling the air drawn into the combustion chamber. The throttle valve is closed in an idle state, a state where the engine load is low, such that a minimal amount of air is inducted into the combustion chamber. In idle, the engine load varies based on a variety of factors such as whether the air conditioner is operated, and how hot the engine coolant is.

Therefore, a gasoline engine is usually provided with an idle speed controller (ISC) for stabilizing the idle speed when the idling load varies. The ISC includes an idle speed actuator (ISA) for controlling an amount of air bypassing the throttle valve. An engine control unit (ECU) activates the ISA to control the engine output power in idle.

When the throttle valve is abruptly shut after being wide open, the amount of air inducted into the engine decreases abruptly. Therefore, the engine speed is apt to become temporarily lower than a target idle speed. In some extreme cases, the engine may stall. A conventional solution is to provide a mechanical dashpot or a dashpot function for controlling the ISA. FIG. 1 illustrates a dashpot function, where the horizontal axis denotes time, and the vertical axes respectively denote: (1) in the middle, a throttle valve opening; (2) in the top, an engine speed according to the throttle opening; and (3) in the bottom, the amount of air drawn into the engine by ISA control based on the throttle valve operation.

As shown in FIG. 1, when the throttle valve opening is abruptly increased at an instant $t_0$, the engine speed rapidly increases. In this case, an engine control unit controls the ISA to a duty ratio such that the ISC air, the air bypassing the throttle valve, greatly increases to a target ISC amount.

When the throttle valve is closed at an instant $t_1$, the engine speed starts to rapidly decrease. The ISA is maintained open for a delay time DLY_TM (DLY_TM=$t_2-t_1$. After the delay time DLY_TM has elapsed at $t_2$, the ISA is controlled so the ISC air monotonically decreases. Therefore, the engine speed rapidly decreases during the delay time DLY_TM. The engine speed then more gradually converges to a target idle speed while the ISC air is monotonically decreasing (after $t_2$). The target ISC amount is calculated from a map table based on a coolant temperature T and a throttle valve opening TH. The delay time DLY_TM is calculated from a map table based on the coolant temperature T.

The dashpot function is implemented using an open-loop control method; the engine speed is not fed back to close the loop. The engine speed decrease is only produced by the delay time DLY_TM and the ISA control pattern. But an engine speed behavior may vary based on the engine operating conditions and/or fuel combustion state. When fuel is cut off while the vehicle is being driven, or when shifting to neutral, the engine speed may rapidly drop to an undesirably low speed or hang at a high speed depending on the exterior air temperature, the air/fuel ratio, and/or the engine age, as well as coolant temperature and throttle valve opening.

Sometimes such extreme reactions are addressed by the delay time DLY_TM and the ISA opening decrease pattern. But in these instances, it has been found that there is a loss of fuel economy and/or driving performance. Furthermore, an empirically determined delay time DLY_TM and ISA opening decrease pattern is unique for each engine. Therefore, they change when specifications of the engine change, necessitating a lot of investigation for each engine.

SUMMARY OF THE INVENTION

A method for controlling an idle speed of an engine according to a preferred embodiment of the invention by actuating an ISA includes: detecting a current engine speed; calculating a dynamic reference speed based on the current engine speed; calculating a target ISA opening based on the dynamic reference speed and the current engine speed; and actuating the ISA based on the target ISA opening.

The calculating of a dynamic reference speed preferably includes: setting the dynamic reference speed to a value in a range that includes a target idle speed and a maximum value of the dynamic reference speed; determining if the dynamic reference speed has increased from a previous dynamic reference speed; determining if a time constant is initialized when the dynamic reference speed is not above the previous dynamic reference speed; initializing the time constant when it is determined that the time constant is not initialized; and modifying the dynamic reference speed based on the time constant and the previous dynamic reference speed.

The setting of the dynamic reference speed sets the dynamic reference speed to a value of "$MAX\{\min(W_L, a_2 \times W - a_3), Ws\}$", where W, Ws, and $W_L$, respectively, denote the current engine speed, the target idle speed, and a maximum value of the dynamic preference speed, and $a_2$ and $a_3$ are predetermined coefficients that satisfy "$0<a_2<1$" and "$0<a_3$". The predetermined maximum value of the dynamic reference speed is preferably a product of the target idle speed and a first predetermined coefficient $a_1$. The initializing of the time constant preferably initializes the time constant based on a coolant temperature, and preferably to different values based on whether a current gear is a drivable gear.

The calculating of the target ISA opening preferably includes: calculating a static deviation as the difference value between the current engine speed and a static target speed; calculating a dynamic deviation as the difference value between the current engine speed and the dynamic reference speed; calculating an engine speed change between the current engine speed and a previous engine speed; and calculating the target ISA opening based on the static deviation, dynamic deviation, and the engine speed change.

The calculating of the target ISA opening based on the static deviation, dynamic deviation, and the engine speed change preferably includes: comparing the dynamic deviation with a predetermined deviation; calculating first and second ISA openings when the dynamic deviation is less than the predetermined deviation, wherein the first ISA opening is calculated based on the dynamic deviation, and the second ISA opening is calculated based on the static deviation and the engine speed change; and calculating the target ISA opening based on the first and second ISA openings.

The calculating of the first and second ISA openings preferably calculates each of the fist and second ISA openings by different functions based on whether a current gear is a drivable gear.

It is also preferable that the calculating of the first and second ISA openings calculates the first ISA opening by a monotonic function of the dynamic deviation and calculates the second ISA opening by a monotonic function of the static deviation and the engine speed change; and calculating the target ISA opening based on the first and second ISA openings calculates the target ISA opening by adding the first and second ISA openings to a base opening, the base opening being an ISA opening that can maintain the engine speed at the target idle speed.

The calculating of the target ISA opening based on the static deviation, the dynamic deviation, and the engine speed change preferably calculates the target ISA opening as a base value when the dynamic deviation is not less than the predetermined deviation, being an ISA opening that can maintain the engine speed at the target idle speed.

A further preferred embodiment includes determining if a predetermined condition for applying the dynamic reference speed is satisfied and calculating the target ISA opening is performed when the predetermined condition for applying the dynamic reference speed is satisfied.

The predetermined condition preferably includes: a predetermined time interval has elapsed after the engine was started; the throttle valve position detector and ISA not malfunctioning; and a predetermined time interval has elapsed after the throttle valve was closed.

The target ISA opening is preferably set to a base opening when the predetermined condition for applying the dynamic reference speed is not satisfied, wherein the base opening is an ISA opening that can maintain the engine speed at the target idle speed.

An exemplary apparatus for controlling an idle speed of an engine useful with the present invention includes: a throttle valve position detector for detecting a throttle valve opening of the engine; an engine speed detector for detecting a revolution speed of the engine; a coolant temperature detector for detecting an engine coolant temperature, the coolant being used to cool the engine; a gear detector for detecting a current gear of a transmission; an ISA for controlling bypass air bypassing the throttle valve; and a control unit for controlling the ISA on the basis of signals input from the detectors, wherein the control unit executes instructions for steps of a method for controlling the idle speed of an engine.

BRIEF DESCRIPTION OF THE DRAWINGS

The accompanying drawings, which are incorporated in and constitute a part of the specification, illustrate an embodiment of the invention, and, together with the description, serve to explain the principles of the invention.

Like numerals refer to similar elements throughout the several drawings.

DETAILED DESCRIPTION OF THE PREFERRED EMBODIMENTS

Figure 1:
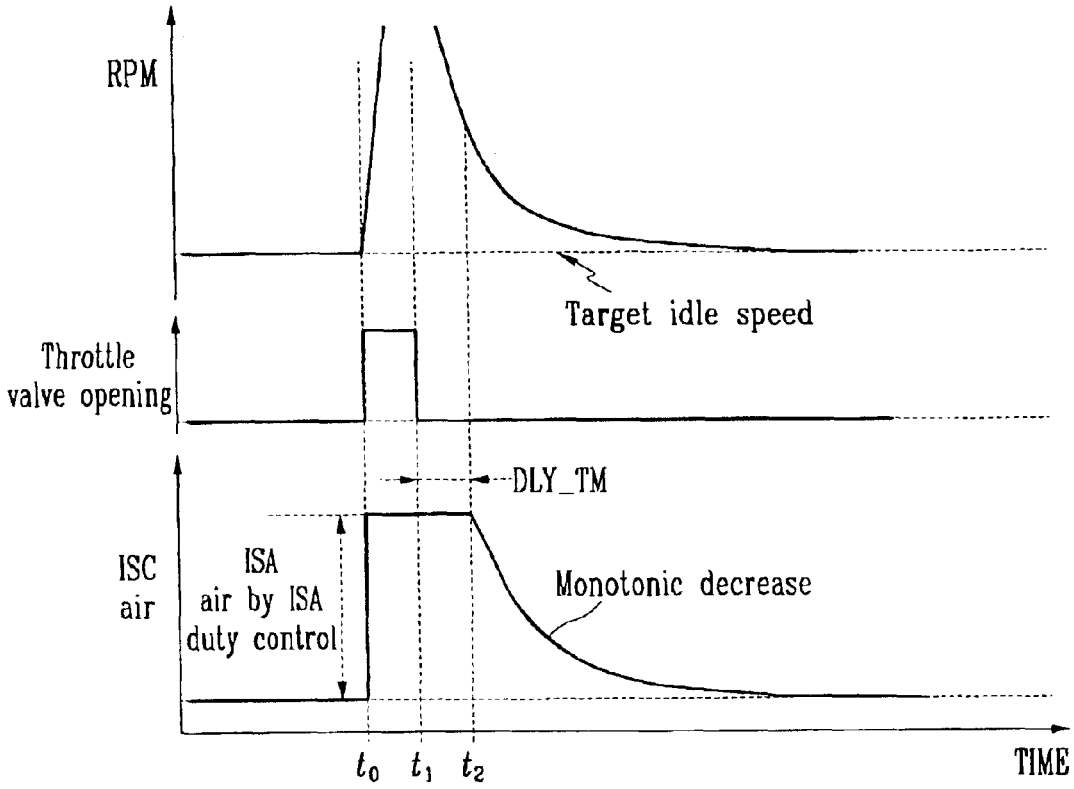
FIG. 1 illustrates engine response to a dashpot function.
Figure 2:
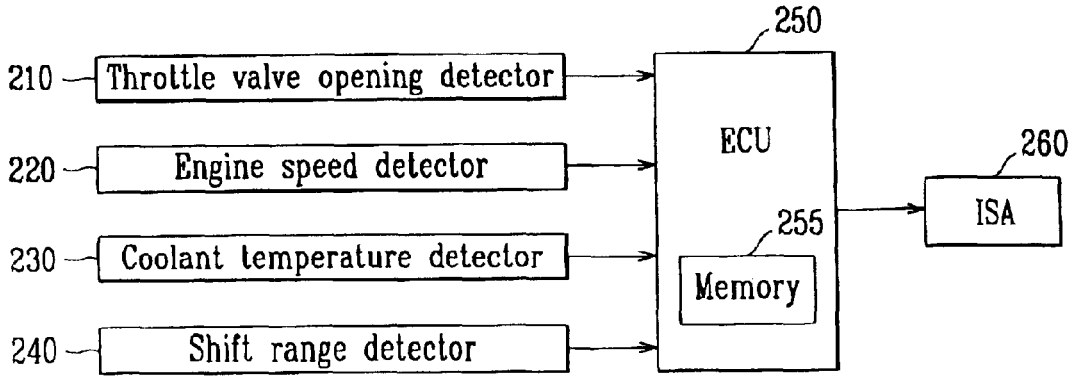
FIG. 2 is a block diagram showing an apparatus for controlling the idle speed of an engine according to a preferred embodiment of the present invention.

In an apparatus for controlling idle speed of an engine according to a preferred embodiment of the present invention, as shown in FIG. 2, a throttle valve position detector 210 detects the position of the throttle valve of the engine. An engine speed detector 220 detects the revolution speed of the engine. A coolant temperature detector 230 detects the engine coolant temperature. A gear detector 240 detects a current gear of the transmission. An idle speed actuator (ISA) 260 controlls bypass air bypassing the throttle valve. And an engine control unit (ECU) 250 controlls the ISA 260 on the basis of signals input from the detectors 210–240. The different types of detectors, the throttle valve position detector 210, the engine speed detector 220, the coolant temperature detector 230, and the ISA 260 would be apparent to a person of ordinary skill in the art.

The gear detector 240 may be a selector lever of an automatic transmission that transmits signals corresponding to shift-ranges, such as P, R, N, D, 2, and L, to the ECU 250 as current gear signals. The gear detector 240 may also be a transmission control unit (TCU) that transmits signals corresponding to shift-speeds such as P, R, N, 4, 3, 2, and 1 to the ECU 250 as a current gear signal. Note that the signal from a selector lever relates to a shift-range of gears, which may include more than one gear ratio, such as D.

The ECU 250 can be one or more processors that are activated by software where the software is programmed to execute instructions for each step of a method for controlling the idle speed of an engine according to a preferred embodiment of this invention. The ECU 250 has a memory 255 for storing values of variables needed to execute the steps of the method. Persons of ordinary skill in the art may select and program suitable hardware according to the teachings of the present invention.

Figure 3:
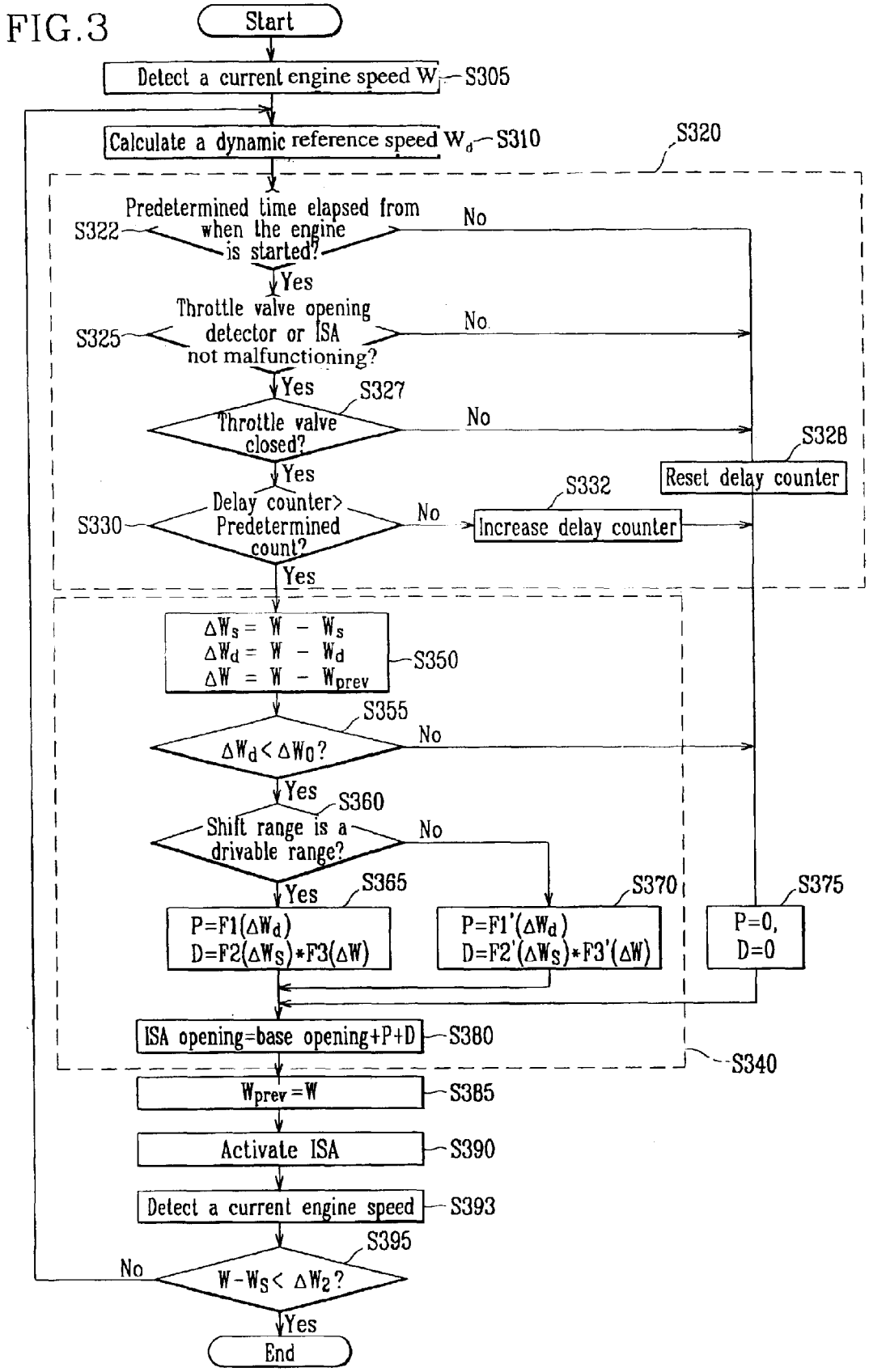
FIG. 3 is a flowchart showing a method for controlling the idle speed of an engine according to a preferred embodiment of the present invention.

In FIG. 3, which is a flowchart showing a method for controlling the idle speed of an engine according to a preferred embodiment of the present invention, at step S305 a current engine speed W is detected. Individual steps will be described in detail below, but generally, at step S310, a dynamic reference speed Wd is calculated based on the detected current engine speed W. At step S320 the ECU 250 determines whether a condition for applying the dynamic reference speed Wd is satisfied. At step S340, a target ISA opening OP is calculated based on the dynamic reference speed Wd and the current engine speed W. At step S390, the ISA 260 is actuated based on the calculated target ISA opening OP.

Figure 4:
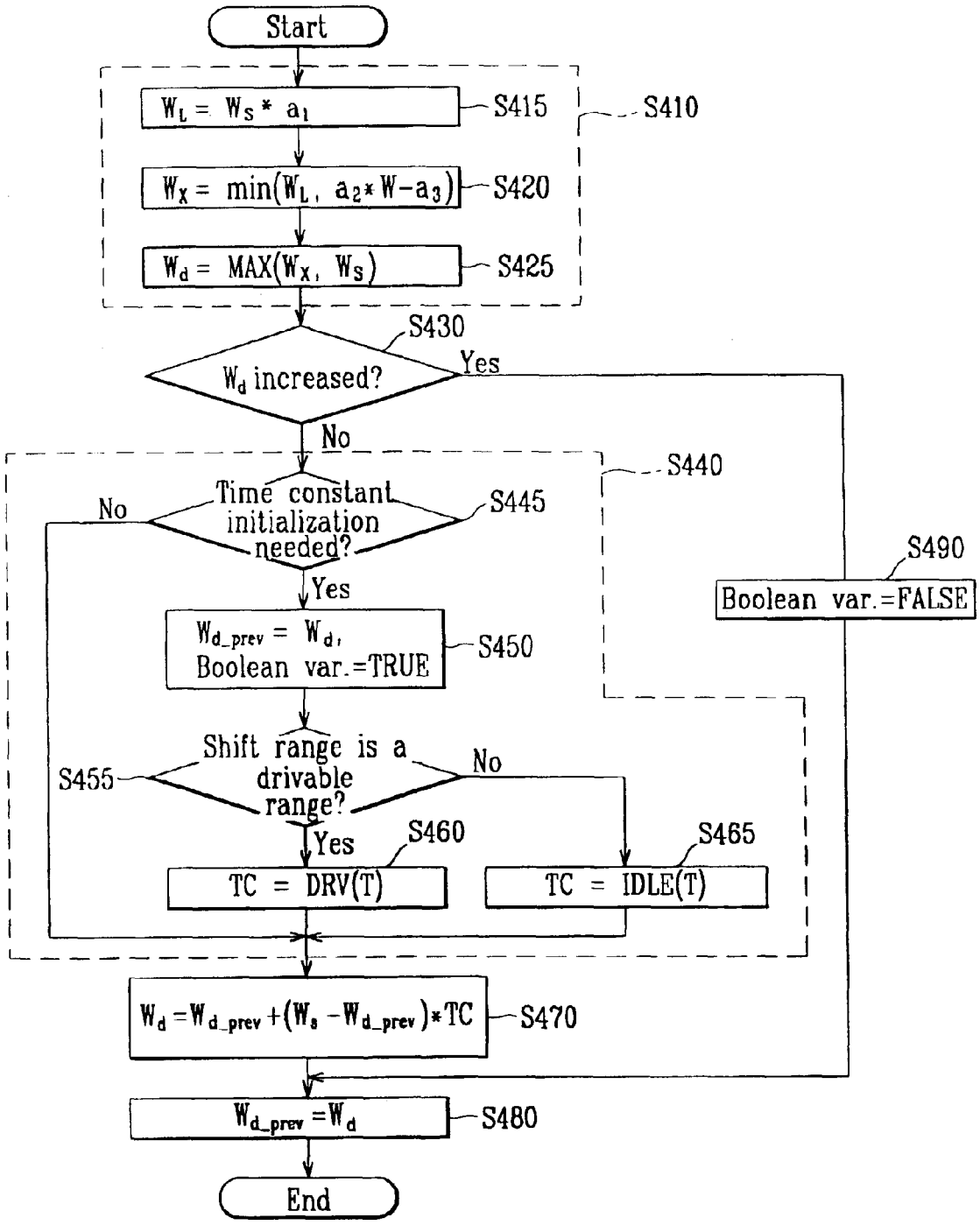
FIG. 4 is a detailed flowchart showing the step of calculating a dynamic reference speed according to a preferred embodiment of the present invention.

The step S310 of calculating the dynamic reference speed Wd is hereinafter described in further detail with reference to FIG. 4. At step S410, the ECU 250 sets the dynamic reference speed Wd to a value within a range that concludes a target idle speed Ws and a maximum value Wmax for the dynamic reference speed. At step S430, the ECU 250 determines if the currently set dynamic reference speed Wd has increased from a previous dynamic reference speed Wd_prev. If not, at step S440 the ECU 250 initializes a time constant TC if the time constant is not initialized, and at step S470 the ECU 250 modifies the dynamic reference speed Wd based on the time constant TC and the previous dynamic reference speed Wd_prev. Then, at step S480 the modified dynamic reference speed Wd is also stored as the previous reference speed. If at step S430 the dynamic reference speed Wd is determined to have increased from the previous speed Wd_prev, at step S490 the ECU 250 sets a Boolean variable to a value of "FALSE", denoting that initialization is needed. Then, at step S480 the newly set dynamic reference speed Wd is also stored as the previous reference speed Wd_prev.

In step S410, the dynamic reference speed Wd is set to a value of "$MAX\{min(W_L, a_2 \times W - a_3), Ws\}$". In the above equation, $W_L$ denotes a maximum value of the dynamic preference speed Wd, and is preset to a value of "$Ws \times a_1$", which is a product of the target idle speed Ws and a first predetermined coefficient $a_1$, the first predetermined coefficient being greater than 1. To set the value of the dynamic reference speed Wd, at step S415 the ECU 250 stores the product of the target idle speed Ws and the first predetermined coefficient $a_1$ to a variable $W_L$. At step S420, the ECU 250 selects the minimum value Wx between the variable $W_L$ and a value "$a_2 \times W - a_3$" and, at step S425, sets the dynamic reference speed Wd to the maximum value between the selected minimum value Wx and the target idle speed Ws.

The coefficients $a_2$ and $a_3$ are predetermined such that the value of "$a_2 \times W - a_3$" is less than W, and therefore they are preset to values that satisfy "$0<a_2<1$" and "$0<a_3$". Specific values thereof will be apparent to a person of ordinary skill in the art. In general, the parameters are adopted to adapt the present invention to specific engine specifications and considering factors such as the desired rate of convergence to the target idle speed. For example, since idle control of the engine is typically carried out up to 2500 RPM, $a_1$ can be chosen so that $W_L$ is within that range. The $a_2$ coefficient depends on displacement and/or the idle racing characteristic of the particular engine and 0.95 is an example of a typical value. The $a_3$ coefficient is an offset parameter for providing a certain band between the dynamic desired RPM and the current engine RPM and is experimentally determined for each particular engine.

At step S440, the time constant TC is initialized based on a coolant temperature T and based on whether a current gear is a drivable gear, such as reverse R or drive D. In more detail, at step S445, the ECU 250 determines whether the time constant initialization is needed based on the Boolean variable, i.e., whether the Boolean variable is "FALSE". If so, at step S450 the ECU 250 stores the current value of the dynamic reference speed Wd as the previous dynamic reference speed Wd_prev, and resets the Boolean variable to "TRUE", denoting that initialization is not needed. Having reset the Boolean variable, at step S455 the ECU determines whether the current gear is a drivable gear and initializes the time constants TC by different functions DRV (at step S460) and IDLE (at step S465) of the coolant temperature T based on whether the current gear is a drivable gear.

At, step S455, a gear is determined to be a drivable gear if the ECU 250 receives from the gear detector 240, a signal that corresponds to: (1) the select lever is in reverse R gear or in a forward shift-range such as drive D, second 2, or low L; or (2) the TCU signals that the gear is a reverse gear, or a forward gear such as first, second, third, or fourth.

The values for the functions DRV and IDLE are obtained from map tables stored in the memory 255. Values for the functions DRV and IDLE can be obtained by persons of ordinary skill in the art with guidance from the following standards. If the fuel supply is cut off and the throttle valve is shut after the engine speed was raised abruptly, the engine speed rapidly decreases to an idle speed. Therefore, the time constant TC is preferably set to a value that makes the rate of decrease less than the rapid free decreasing speed. The values for this time constant change depending on whether the transmission is in a drivable gear.

In the step S470, the ECU 250 modifies the dynamic reference speed Wd by an equation "$Wd=Wd_prev+(Ws-Wd_prev)\times TC$" based on the time constant TC and the previous dynamic reference speed Wd_Prev. The amount of modification is, thus, proportional to the time constant TC and a difference between the target idle speed Ws and the previous dynamic reference speed Wd_prev. Accordingly, the dynamic reference speed Wd is modified, at every iteration, proportionally to the time constant TC and the difference between the target idle speed Ws and the previous dynamic reference speed Wd_prev, if the dynamic reference speed Wd is decreasing.

Referring back to FIG. 3, at step S320 the ECU 250 determines whether a condition for applying the dynamic reference speed Wd is satisfied. The condition is that, at step S322: a time interval has elapsed after the engine was started; at step S325 the throttle valve position detector 210 and ISA 260 are not malfunctioning; and at step S327 a time interval has elapsed since the throttle valve was closed. In addition, at step S330 the ECU 250 determines whether the condition has existed for a predetermined time by determining whether a delay counter has a value greater than a predetermined count. If the value of the delay counter is not greater than the predetermined count, at step S332 the ECU 250 increases the delay counter by a unit increment. If any of steps S322, S325, or S327 have not occurred, at step S328 the ECU 250 resets the delay counter to the value of "0".

At step S340, after the condition at step S320 for applying the dynamic reference speed Wd is determined to be satisfied, the ECU 250 calculates a target ISA opening OP based on the dynamic reference speed Wd and the engine speed W. In more detail, at step S350, the ECU 250 calculates: a static deviation $\Delta Ws$ as a difference value "W−Ws" between the current engine speed W and a static target speed Ws; a dynamic deviation $\Delta Wd$ as a difference value "W−Wd" between the current engine speed W and the dynamic reference speed Wd; and an engine speed change $\Delta W$ between the current engine speed $\Delta W$ and a previous engine speed Wprev.

Subsequently, the ECU 250 compares the dynamic deviation $\Delta Wd$ with a predetermined deviation $\Delta W_0$ at step S355. If the dynamic deviation $\Delta Wd$ is less then the predetermined deviation $\Delta W_0$, the ECU 250 calculates a first ISA opening "P" that is dependent on the dynamic deviation $\Delta Wd$, and a second ISA opening "D" that is dependent on the static deviation $\Delta Ws$ and the engine speed change $\Delta W$. To do this, at step S360 the ECU 250 determines whether a current gear is a drivable gear. If so, the ECU 250 at step S365 calculates the first and second ISA openings P and D by equations "$P=F_1(\Delta Wd)$" and "$D=F_2(\Delta Ws)\times F_3(\Delta W)$". If not, at step S370, the ECU 250 uses the equations "$P=F_1'(\Delta Wd)$" and "$D=F_2'(\Delta Ws)\times F_3'(\Delta W)$" to calculate P and D.

The above functions $F_1$, $F_2$, $F_3$, $F_1'$, $F_2'$, and $F_3'$ are preferably monotonic functions of their independent variables. One of ordinary skill in the art will know these functions should reflect the specifications of the engine and an intended pattern for how the engine speed is to converge to the target idle speed. A guideline for setting preferable values of the functions is provided as follows.

The function $F_1$ should be designed to provide a sufficient amount of air to bypass the throttle valve in the case that the dynamic deviation $\Delta Wd$ is large. If $F_1$ is large, the value of the first ISA opening P will need to be correspondingly large.

The function $F_2$ is preferably monotonically increasing on the static deviation $\Delta Ws$. In this case, the dashpot function is increased when the static deviation $\Delta Ws$ is high. The second ISA opening D converges to a predetermined value, for example, the value "0", as the static deviation ΔWs converges to "0". This diminishes the dashpot function as the engine speed W converges to the target idle speed Ws.

The function $F_3$ is devised to reflect the engine speed change to the second ISA opening D, and preferably increases as the engine speed change increases. The function $F_3$ has positive values when the engine speed increases and negative values when the engine speed decreases, so the target ISA opening OP is reduced when the engine speed decreases. The values of the functions $F_1$, $F_2$, $F_3$, $F_1'$, $F_2'$, and $F_3'$ are pre-installed in the memory 255 as map tables.

At step S355, when the dynamic deviation ΔWd is not less than the predetermined deviation $\Delta W_0$, or after steps S328 or S332, at step S375 the ECU 250 sets both the first and second ISA openings P and D to the value of "0". Because the first and second ISA openings P and D are set to "0" in the case that the engine speed is above the dynamic reference by more than the predetermined deviation $\Delta W_0$, the engine speed W can rapidly converge to the target idle speed Ws.

After the first and second ISA openings P and D are calculated at any of steps S365, S370, and S375, the ECU 250 at step S380 calculates the target ISA opening by adding the first and second ISA openings P and D to a base opening. The base opening, denoting an ISA opening that can maintain the engine speed at the target idle speed, is obtained by testing the engine. The testing needed will be apparent to one of ordinary skill in the art.

Continuing, at step S385 the ECU 250 stores the value of the current engine speed W to the previous engine speed variable Wprev. The ECU 250 at step S390 actuates the ISA 260 based on the target ISA opening OP. Then, at step S393, the ECU 250 again detects the current engine speed W. At step S395 the ECU 250 compares the newly detected current engine speed W with the target idle speed Ws.

If the current engine speed W falls within a range ΔW2 from the target idle speed Ws, the engine speed W is considered to have converged to the target idle speed Ws. Therefore, the ECU 250 stops executing the idle speed control method.

If the current engine speed is not within the range ΔW2, the ECU 250 goes back to the step S310 for calculating the dynamic reference speed Wd so the engine speed W can be controlled until the engine speed W is sufficiently close to the target idle speed Ws.

Figure 5:
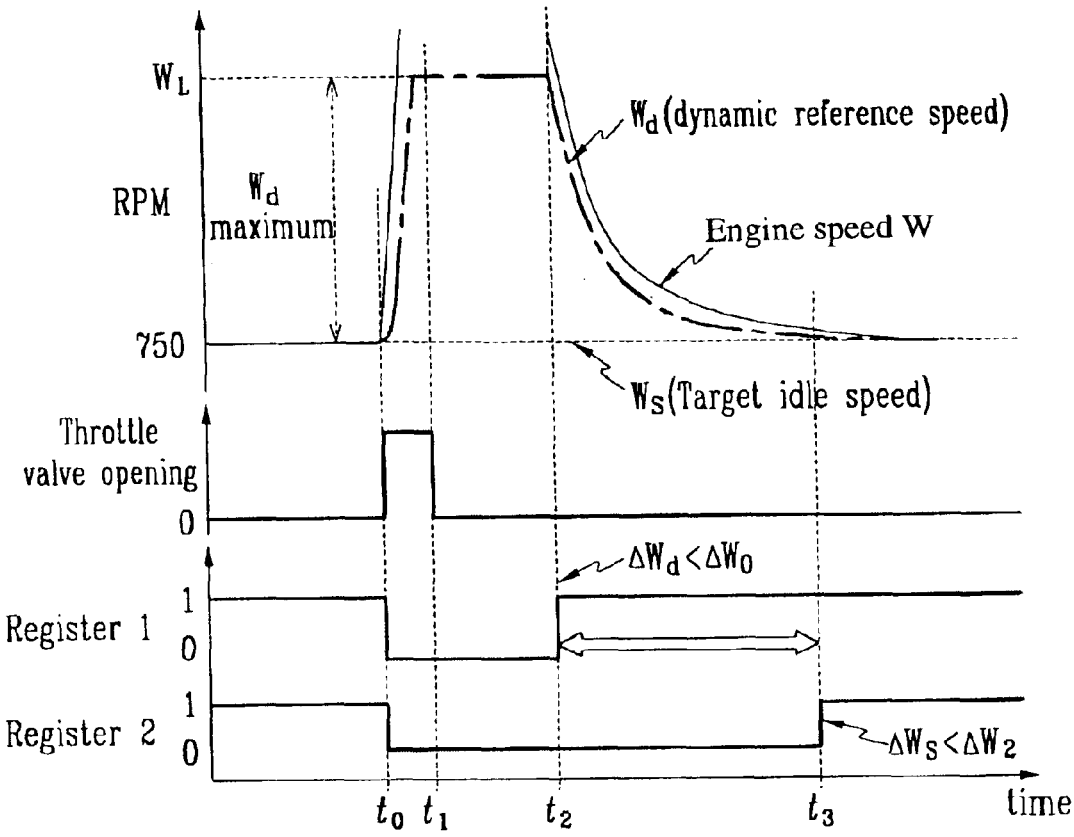
FIG. 5 illustrates engine speed converging to a target idle speed according to a preferred embodiment of the present invention.

The engine speed W converges to the target idle speed Ws according to a preferred embodiment of the present invention, described in detail with reference to FIG. 5. In FIG. 5, the horizontal axis denotes time, and the vertical axes are: engine speed (RPM); throttle valve opening; a first register for showing whether the dynamic deviation ΔWd is less than the predetermined deviation $\Delta W_0$; and a second register for showing whether the static deviation ΔWs is within a range $\Delta W_2$, that is, whether the engine speed W is close to the target idle speed Ws.

As shown in FIG. 5, when the throttle valve is abruptly opened at time $t_0$, the engine speed abruptly increases. Accordingly, the dynamic reference speed Wd, calculated at every iteration of the process shown in FIG. 4, also. The increase is stopped at the maximum value $W_L$.

At time $t_1$, the throttle valve is closed and the engine speed W rapidly decreases. A dynamic control of the engine speed W according to a preferred embodiment of the present invention is activated at $t_2$, the moment when the dynamic deviation ΔWd becomes less than the predetermined deviation $\Delta W_0$.

After $t_2$, the dynamic reference speed Wd keeps being modified (at step S470) to be less than the engine speed W and greater than the target idle speed Ws and the ISA 260 is actuated (at step S390) by an ISA opening value that corresponds to the dynamic reference speed Wd. Therefore, the engine speed W monotonically decreases and converges to the target idle speed Ws.

When the static deviation ΔWs, a difference between the engine speed W and the target idle speed Ws, becomes less than the value $\Delta W_2$ at time $t_3$, the dynamic control of the engine speed W according to a preferred embodiment of the present invention stops and the ISA 260 is controlled by the base opening used to maintain the engine speed at the target idle speed Ws.

With the present invention the investigation needed to establish map tables for each engine to control idle speed is substantially reduced. Also, engine aging is addressed efficiently because the ideal converging of the engine speed to the target idle speed is controlled without reference to engine specifications, only engine speed.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A method for controlling an idle speed of an engine by actuating an idle speed actuator (ISA), the method comprising:

detecting a current engine speed;

calculating a dynamic reference speed based on the current engine speed;

calculating a target ISA opening based on the dynamic reference speed and the current engine speed; and actuating the ISA based on the target ISA opening.

2. The method of claim 1 wherein the calculating a dynamic reference speed comprises:

setting the dynamic reference speed to a value in a range that includes a target idle speed and a maximum value of the dynamic reference speed;

determining if the dynamic reference speed has increased from a previous dynamic reference speed;

determining if a time constant is initialized when the dynamic reference speed is not above the previous dynamic reference speed;

initializing the time constant when it is determined that the time constant is not initialized; and modifying the dynamic reference speed based on the time constant and the previous dynamic reference speed.

3. The method of claim 2 wherein the setting the dynamic reference speed sets the dynamic reference speed to a value of "MAX{min(W.sub.L, a.sub.2.times.W-a.sub.3), Ws}", where W, Ws, and W.sub.L, respectively, denote the current engine speed, the target idle speed, and a maximum value of the dynamic preference speed, and a.sub.2 and a.sub.3 are predetermined coefficients that satisfy "0<a.sub.2<1" and "0<a.sub.3".

4. The method of claim 3 wherein the predetermined maximum value of the dynamic reference speed is a product of the target idle speed and a first predetermined coefficient a.sub. 1.

5. The method of claim 2 wherein the initializing the time constant initializes the time constant based on a coolant temperature.

6. The method of claim 2 wherein the initializing the time constant initializes the time constant to different values based on whether a current gear is a drivable gear.

7. The method of claim 1 wherein the calculating the target ISA opening comprises:

calculating a static deviation as a difference between the current engine speed and a static target speed;

calculating a dynamic deviation as a difference between the current engine speed and the dynamic reference speed;

calculating an engine speed change between the current engine speed and a previous engine speed; and calculating the target ISA opening based on the static deviation, dynamic deviation, and the engine speed change.

8. The method of claim 7 wherein the calculating the target ISA opening based on the static deviation, dynamic deviation, and the engine speed change comprises:

comparing the dynamic deviation with a predetermined deviation;

calculating first and second ISA openings when the dynamic deviation is less than the predetermined deviation, wherein the first ISA opening is calculated based on the dynamic deviation and the second ISA opening is calculated based on the static deviation and the engine speed change; and calculating the target ISA opening based on the first and second ISA openings.

9. The method of claim 8 wherein the calculating first and second ISA openings calculates each of the fist and second ISA openings by different functions based on whether a current gear is a drivable gear.

10. The method of claim 8 wherein:

the calculating first and second ISA openings calculates the first ISA opening by a monotonic function of the dynamic deviation and calculates the second ISA opening by a monotonic function of the static deviation and the engine speed change; and the calculating the target ISA opening based on the first and second ISA openings calculates the target ISA opening by adding the first and second ISA openings to a base opening, the base opening being an ISA opening that can maintain the engine speed at the target idle speed.

11. The method of claim 8 wherein the calculating the target ISA opening based on the static deviation, dynamic deviation, and engine speed change calculates the target ISA opening as a base opening when the dynamic deviation is not less than the predetermined deviation, the base opening being an ISA opening that can maintain the engine speed at the target idle speed.

12. The method of claim 1 further comprising determining if a predetermined condition for applying the dynamic reference speed is satisfied, wherein the calculating the target ISA opening is performed when the predetermined condition for applying the dynamic reference speed is satisfied.

13. The method of claim 12 wherein the predetermined condition comprises:

a predetermined time interval having elapsed after the engine was started;

the throttle valve position detector and ISA not malfunctioning; and a predetermined time interval having elapsed after the throttle valve was closed.

14. The method of claim 12 further comprising setting the target ISA opening to a base opening when the predetermined condition for applying the dynamic reference speed is not satisfied, the base opening being an ISA opening that can maintain the engine speed at the target idle speed.

15. An apparatus for controlling an idle speed of an engine comprising:

a throttle valve position detector for detecting a throttle valve opening of the engine;

an engine speed detector for detecting a revolution speed of the engine;

a coolant temperature detector for detecting an engine coolant temperature;

a gear detector for detecting a current gear of a transmission;

an ISA for controlling bypass air bypassing the throttle valve; and a control unit for controlling the ISA on the basis of said signals input from the detectors, wherein the control unit executes instructions for maintaining stable engine idle by;

actuating the ISA based on a detected engine speed;

detecting a current engine speed;

calculating a dynamic reference speed based on the current engine speed;

calculating a target ISA opening based on the dynamic reference speed and the current engine speed; and actuating the ISA based on the target ISA opening.

16. The apparatus of claim 15 wherein the calculating a dynamic reference speed comprises:

setting the dynamic reference speed to a value in a range that includes a target idle speed and a maximum value of the dynamic reference speed;

determining if the dynamic reference speed has increased from a previous dynamic reference speed;

determining if a time constant is initialized when the dynamic reference speed is not above the previous dynamic reference speed;

initializing the time constant when it is determined that the time constant is not initialized; and modifying the dynamic reference speed based on the time constant and the previous dynamic reference speed.

17. The apparatus of claim 16 wherein the initializing the time constant initializes the time constant based on a coolant temperature.

18. The apparatus of claim 16 wherein the initializing the time constant initializes the time constant to different values based on whether a current gear is a drivable gear.

19. The apparatus of claim 15 wherein the setting the dynamic reference speed sets the dynamic reference speed to a value of "MAX{min(W.sub.L, a.sub.2.times.W-a.sub.3), Ws}", where W.sub.L is a maximum value of the dynamic preference speed, and a.sub.2 and a.sub.3 are predetermined coefficients that satisfy "0<a.sub.2<1" and "0<a.sub.3".

20. The apparatus of claim 19 wherein the predetermined maximum value of the dynamic reference speed is a product of the target idle speed with a first predetermined coefficient a.sub.1.

21. The apparatus of claim 15 wherein the calculating a target ISA opening comprises:

calculating a static deviation as the difference value between the current engine speed and a static target speed;

calculating a dynamic deviation as the difference value between the current engine speed and the dynamic reference speed;

calculating an engine speed change between the current engine speed and a previous engine speed; and calculating the target ISA opening based on the static deviation, dynamic deviation, and the engine speed change.

22. The apparatus of claim 21 wherein the calculating the target ISA opening based on the static deviation, dynamic deviation, and the engine speed change comprises:

comparing the dynamic deviation with a predetermined deviation;

calculating first and second ISA openings when the dynamic deviation is less than the predetermined deviation, wherein the first ISA opening is calculated based on the dynamic deviation and the second ISA opening is calculated based on the static deviation and the engine speed change; and calculating the target ISA opening based on the first and second ISA openings.

23. The apparatus of claim 22 wherein the calculating first and second ISA openings calculates each of the fist and second ISA openings by different functions based on whether a current gear is a drivable gear.

24. The apparatus of claim 22 wherein:

the calculating first and second ISA openings calculates the first ISA opening by a monotonic function of the dynamic deviation and calculates the second ISA opening by a monotonic function of the static deviation and the engine speed change; and calculating the target ISA opening based on the first and second ISA openings calculates the target ISA opening by adding the first and second ISA openings to a base opening, the base opening being an ISA opening that can maintain the engine speed at the target idle speed.

25. The apparatus of claim 22 wherein the calculating the target ISA opening based on the static deviation, dynamic deviation, and the engine speed change calculates the target ISA opening as a base opening when the dynamic deviation is not less than the predetermined deviation, the base opening being an ISA opening that can maintain the engine speed at the target idle speed.

26. The apparatus of claim 15 further comprising determining if a predetermined condition for applying the dynamic reference speed is satisfied, wherein the calculating a target ISA opening is performed when the predetermined condition for applying the dynamic reference speed is satisfied.

27. The apparatus of claim 26 wherein the predetermined condition comprises:

a predetermined time interval having elapsed after the engine was started;

the throttle valve position detector and ISA not malfunctioning; and a predetermined time interval having elapsed after the throttle valve was closed.

28. The apparatus of claim 26 further comprising setting the target ISA opening to a base opening when the predetermined condition for applying the dynamic reference speed is not satisfied, the base opening being an ISA opening that can maintain the engine speed at the target idle speed.

* * * * *